US008594552B2

(12) United States Patent
Yamamoto et al.

(10) Patent No.: US 8,594,552 B2
(45) Date of Patent: Nov. 26, 2013

(54) BLADE FOR ELECTROPHOTOGRAPHIC APPARATUS, AND PROCESS FOR MANUFACTURING THE SAME

(75) Inventors: Arihiro Yamamoto, Ushiku (JP); Erika Umeki, Toride (JP); Syouji Inoue, Ushiku (JP)

(73) Assignee: Canon Kasei Kabushiki Kaisha, Tsukuba-shi (JP)

( * ) Notice: Subject to any disclaimer, the term of this patent is extended or adjusted under 35 U.S.C. 154(b) by 212 days.

(21) Appl. No.: 13/044,754

(22) Filed: Mar. 10, 2011

(65) Prior Publication Data

US 2011/0243624 A1 Oct. 6, 2011

(30) Foreign Application Priority Data

Mar. 30, 2010 (JP) ..... 2010-077776
Nov. 22, 2010 (JP) ..... 2010-260124

(51) Int. Cl.
*G03G 21/00* (2006.01)

(52) U.S. Cl.
USPC ..... 399/350; 399/264; 399/343; 264/279; 15/256.51

(58) Field of Classification Search
USPC ..... 399/99, 249, 264, 273, 279, 343, 350; 15/256.5, 256.51, 257.1; 264/279
See application file for complete search history.

(56) References Cited

U.S. PATENT DOCUMENTS 5,450,184 A * 9/1995 Yanai et al. ..... 399/350
6,703,472 B2 3/2004 Miura et al.
7,254,364 B2 * 8/2007 Nakayama ..... 399/345
7,619,052 B2 11/2009 Inoue et al.
7,778,585 B2 * 8/2010 Uchida et al. ..... 399/350
8,095,050 B2 1/2012 Iwata et al.
8,275,302 B2 9/2012 Sako et al.
2006/0216226 A1 * 9/2006 Mitsunaka et al. ..... 423/629

(Continued)

FOREIGN PATENT DOCUMENTS

CN 101279501 A 10/2008
CN 101588904 A 11/2009

(Continued)

OTHER PUBLICATIONS

Notification of First Office Action dated Sep. 6, 2012, in Chinese Application No. 201110079200.7.

(Continued)

*Primary Examiner* — David Gray
*Assistant Examiner* — Francis Gray
(74) *Attorney, Agent, or Firm* — Fitzpatrick, Cella, Harper & Scinto

(57) ABSTRACT

To provide a blade for electrophotographic apparatus that can have much superior durability as being made low frictional at its touching part and also improved in bonding force between the touching part and the blade member, a blade for electrophotographic apparatus is provided which has a blade member having a touching part which is to come into touch with an object member, and a support member which holds the blade member; the touching part being formed of a material which is different from that for the blade member; the touching part having a touching face having a coefficient of static friction which is smaller than that of a surface of the blade member; and the touching part having a joint surface at which the touching part is joined with the blade member which joint surface has a center line average roughness Ra of from 0.5 μm to 10.0 μm.

7 Claims, 5 Drawing Sheets

(56) References Cited

U.S. PATENT DOCUMENTS

| | | | | |
|---|---|---|---|---|
| 2008/0247791 | A1 | 10/2008 | Iwata et al. | |
| 2008/0260440 | A1 | 10/2008 | Mochizuki et al. | |
| 2009/0022530 | A1 | 1/2009 | Inoue et al. | |
| 2010/0008707 | A1 * | 1/2010 | Sako et al. | 399/350 |

FOREIGN PATENT DOCUMENTS

| | | | |
|---|---|---|---|
| JP | 4-212190 | A | 8/1992 |
| JP | 2000-112253 | A | 4/2000 |
| JP | 2005-181434 | A | 7/2005 |
| JP | 2006-235506 | A | 9/2006 |
| JP | 2007-163676 | A | 6/2007 |

OTHER PUBLICATIONS

Notice of Preliminary Rejection dated Aug. 8, 2012, in Korean Application No. 10-2011-0025366.

* cited by examiner

BLADE FOR ELECTROPHOTOGRAPHIC APPARATUS, AND PROCESS FOR MANUFACTURING THE SAME

BACKGROUND OF THE INVENTION

1. Field of the Invention

The present invention relates to a blade for electrophotographic apparatus which blade is used in electrophotographic apparatus, and a process for manufacturing the same.

2. Description of the Related Art

In general, in electrophotographic apparatus, images are formed in such a cycle that a toner in a developer container is uniformly charged, which is then made to adhere to an electrostatic latent image on a photosensitive member to develop the latent image to form a toner image, thereafter the toner image is transferred to a recording medium such as a paper sheet, a belt, and thereafter any toner remaining on the photosensitive member is removed. Accordingly, the electrophotographic apparatus are each provided with, e.g., a cleaning blade which is made up of a support and joined thereto a blade member, and a developer blade which forms a thin layer of toner while triboelectrically charging the toner in the developer container.

This cleaning blade is required to have various properties and performance. They may include, e.g., wear resistance for making the blade highly durable, low frictional properties for preventing its turn-over, noise generation and making the photosensitive member drivable at a low torque, cleaning performance in broader environmental ranges, and resistance to compression set caused by its long-term pressure touch with the photosensitive member. In recent years, with much further progress toward high-speed printing and high durability and also for the purpose of making image quality higher, toners have been made to have spherical particles and small particle diameter, and hence the cleaning blade is sought to have the above properties and performance at higher levels.

Conventionally, the cleaning blade is integrally formed of a support member made of a metal, through which the blade is to be attached to an electrophotographic apparatus or the like, and a blade member made of an elastic material, which stands attached to one end portion of the support member. Then, as a material for making up the blade member, a heat-curable polyurethane elastomer is usually used as being excellent in the wear resistance and the resistance to compression set.

Here, in order for the cleaning blade to be improved in cleaning performance, it is considered to bring the cleaning blade into touch with the photosensitive member at a higher pressure, i.e., to make larger the level of penetration in bringing the blade into touch with the photosensitive member. In such a case, however, a large frictional force may come between the cleaning blade and the photosensitive member to remarkably cause problems that the cleaning blade turns over, makes noise and makes the photosensitive member driven at a high torque. Hence, it is sought to make the cleaning blade low frictional at its part coming into touch with the photosensitive member.

Accordingly, in order to make the blade low frictional at its part coming into touch with any member (hereinafter this part is also termed "touching part"), various methods have conventionally been attempted.

(1) As a first method, a method may be given in which a blade is coated on its surface with a lubricating powder.

(2) As a second method, a method may be given in which a blade material heat-curable polyurethane elastomer is made highly hard as a whole to make the blade low frictional.

(3) As a third method, a method may be given in which a blade member made of a heat-curable polyurethane elastomer is made low frictional only at its surface to keep elasticity of the whole blade. For example, as disclosed in Japanese Patent Application Laid-open No. 2007-163676, a liquid synthetic resin that forms a partial layer is casted in the form of a bead into one mold of a split mold, and thereafter the mold is assembled and then a base layer is formed so as to make the blade member highly hard and highly repulsive only at its touching part to make it low frictional at that part. The method disclosed in Japanese Patent Application Laid-open No. 2007-163676 enables manufacture of a blade for electrophotographic apparatus in which, as shown in FIG. 1, touching part 3 coming into touch with a photosensitive member or the like is formed of a material different from that for a blade member 2 attached to one end portion of a support member 1.

The above methods, however, have brought about problems as stated below.

(1) In the first method, it may be difficult to perform uniform coating. Also, the coating formed may tend to come off to result in a poor durability. Further, it follows to use a halogen type organic solvent when coated, which may be undesirable for environment.

(2) In the second method, if the blade material is made highly hard to a level of making it low frictional, it may scratch the photosensitive member or developing roller. Also, the blade may come insufficient in rubber elasticity required therefor.

(3) In the third method, a touching part made of a different material is partially formed on the blade member at its touching face, and hence the touching part may come separated from the blade member where the level of penetration in bringing the blade into touch with the photosensitive member is set larger or where the blade is made highly durable.

SUMMARY OF THE INVENTION

Accordingly, the present invention aims to provide a blade for electrophotographic apparatus that can have much superior durability as being made low frictional at its touching part and also improved in bonding force between the touching part and the blade member.

With such an aim, the present invention is a blade for electrophotographic apparatus which blade comprises a blade member having a touching part which is to come into touch with an object member, and a support member which holds the blade member; the touching part comprising a material which is different from that for the blade member; the touching part having a touching face having a coefficient of static friction which is smaller than that of a surface of the blade member; and the touching part having a joint surface at which the touching part is joined with the blade member which joint surface has a center line average roughness Ra of from 0.5 μm to 10.0 μm.

The present invention is also a process for manufacturing a blade for electrophotographic apparatus which blade comprises a blade member having a touching part which is to come into touch with an object member, and a support member which holds the blade member; the process comprising the steps of: (1) placing a material for the touching part on an internal surface of a mold with which the blade member is to be molded; (2) curing the material for the touching part while the surface thereof is so formed as to have a center line average roughness Ra of from 0.5 μm to 10.0 μm; and (3) casting a material for the blade member into the mold, followed by heat curing.

The present invention enables the blade to be made low frictional at its touching part and also to be improved in bonding force between the touching part and the blade member, and can provide a blade for electrophotographic apparatus that has much superior durability. Thus, the present invention enables a blade for electrophotographic apparatus to be obtainable which can prevent its turn-over and noise generation, can succeed in making the photosensitive member drivable at a low torque and, when used as a cleaning blade, can maintain a good cleaning performance over a long period of time.

Further features of the present invention will become apparent from the following description of exemplary embodiments with reference to the attached drawings.

DESCRIPTION OF THE EMBODIMENTS

Preferred embodiments of the present invention will now be described in detail with reference to the accompanying drawings.

The present invention is concerned with a blade for electrophotographic apparatus which blade has a blade member having a touching part which is to come into touch with an object member, and a support member which holds the blade member. The object member may include, e.g., a photosensitive member and a developing roller.

The touching part is formed of a material which is different from that for the blade member, and a touching face (a face which is to come into touch with the object member) in the touching part has a coefficient of static friction which is smaller than that of the surface of the blade member.

The touching part also has a joint surface at which the touching part is joined with the blade member which joint surface has a center line average roughness Ra of from 0.5 μm to 10.0 μm. That is, even though the material constituting the touching part is different from the material for the blade member, the joint surface of the touching part has a roughened-surface profile having the stated roughness, and hence a strong bonding force on account of an anchor effect is attained at the interface between the touching part and the blade member. In particular, where a material that provides a small coefficient of static friction is used in the touching part, the bonding between the blade member and the touching part may be of low performance, and hence the improvement in bonding force that utilizes the anchor effect is effective. Here, if the joint surface of the touching part has a Ra of less than 0.5 μm, the anchor effect is not obtainable to come short in the bonding force. Hence, where the level of penetration in bringing the blade into touch with the object member is set larger, a problem may come about in durability. If on the other hand the joint surface has a Ra of more than 10 μm, the blade may come into touch with the object member such as a photosensitive member at a locally non-uniform touch pressure to cause faulty images such as vertical lines due to faulty cleaning.

The center line average roughness Ra may be measured according to JIS B-0601 (1994). For example, it may be measured with a surface roughness meter (SURFCORDER SE3500, manufactured by Kosaka Laboratory Ltd.) at a measuring rate of 0.1 mm/second, in a measuring length of 2.5 mm and at a cut-off value of 0.8 mm.

The touching part is formed in the blade member along the part coming into touch with the object member. That is, the touching part is so formed that its touching face stands bare on the same plane as the blade member and the touching part is embedded in the blade member.

Figure 4A:
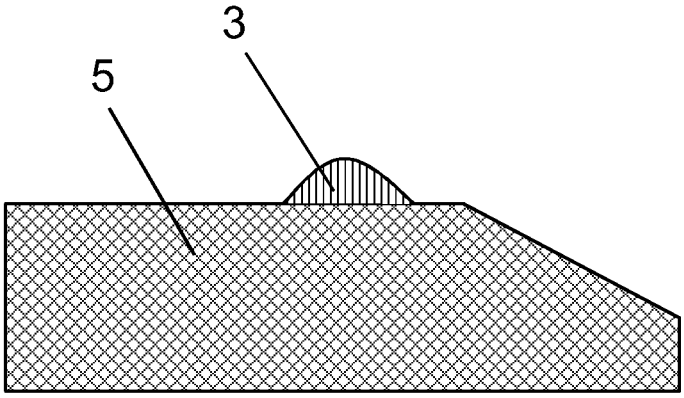
FIG. 4A is a schematic sectional view to illustrate how to form the touching part in the manufacturing process of the present invention.
Figure 4B:
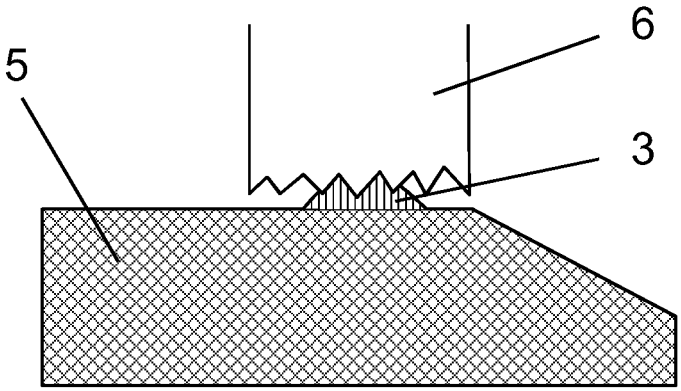
FIG. 4B is a schematic sectional view to illustrate how to form the touching part in the manufacturing process of the present invention.

As a method by which the roughened-surface profile of the joint surface is formed, as shown in FIGS. 4A and 4B, a plate member 6 having a well releasable roughened face on which the desired roughness has beforehand been formed may be pressed at the roughened face against a touching part material placed on a part of a mirror surface portion of a top force 5 of a mold for, e.g., cleaning blade, to transfer the roughened-surface profile to the touching part material. Also, where the touching part material is a coating material, the roughened-surface profile may be formed in the course of evaporating a solvent of the coating material to dryness.

Figure 1:
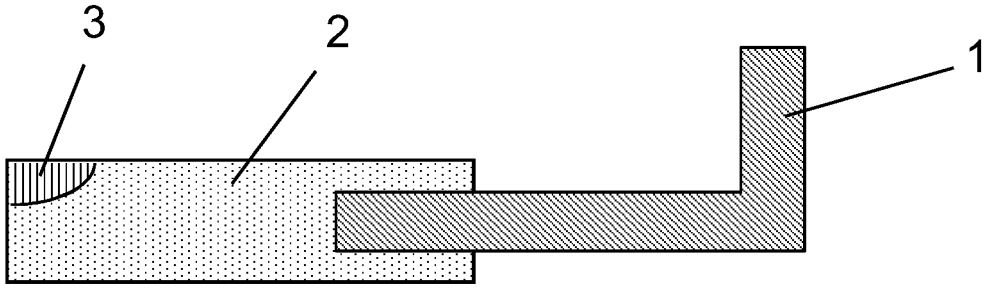
FIG. 1 is a sectional view of a conventional blade for electrophotographic apparatus.
Figure 2A:
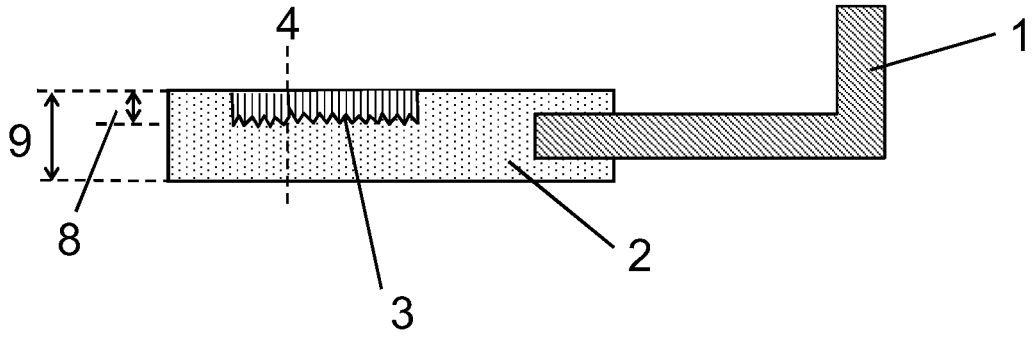
FIG. 2A is a schematic sectional view showing an example of the embodiments of the present invention.
Figure 3A:
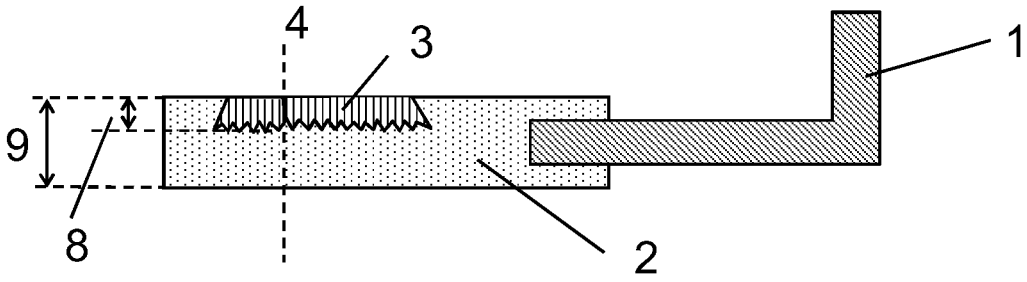
FIG. 3A is a schematic sectional view showing another example of the embodiments of the present invention.

Stated more specifically, the blade for electrophotographic apparatus according to the present invention may be manufactured in the following way. First, the internal surface of a split mold is coated with the touching part material at the former's position where the touching part is to be formed. Next, the plate member having the roughened face having a stated surface roughness is pressed at the roughened face against the touching part material to transfer the roughened-surface profile to the touching part material. In order to set the surface roughness of the touching part material to the desired value, it is preferable to make the roughened face of the plate member have a little larger surface roughness than the desired value. Subsequently, the touching part material is cured in the state the plate member is pressed at its roughened face against the touching part material. As a means for curing, it may appropriately be selected in accordance with the form of curing of the touching part material, and may make use of a heat-curable resin, a thermoplastic resin, an ultraviolet ray curable resin, an electron ray curable resin or the like. Thereafter, the split mold is assembled, and then a heat-curable resin or the like serving as a material for the blade member is casted into the mold, followed by heating to carry out integral molding. When the split mold is assembled, a part of the support member may be set in the interior of a cavity of the mold, and then the material for the blade member may be casted thereinto, whereby the support member and the blade member can be formed in an integral form. Thereafter, the touching part and the blade member may be cut in their longitudinal direction to make an edge of the touching part. Reference numerals 4 in FIGS. 2A and 3A each denote the position of cutting. Reference numerals 8 therein each denote the thickness of a touching part 3; and 9, the thickness of the whole inclusive of a blade member. Thus, a blade for electrophotographic apparatus can be obtained which has the touching part 3 at an end portion on the side opposite to a support member of the blade member.

Figure 3B:
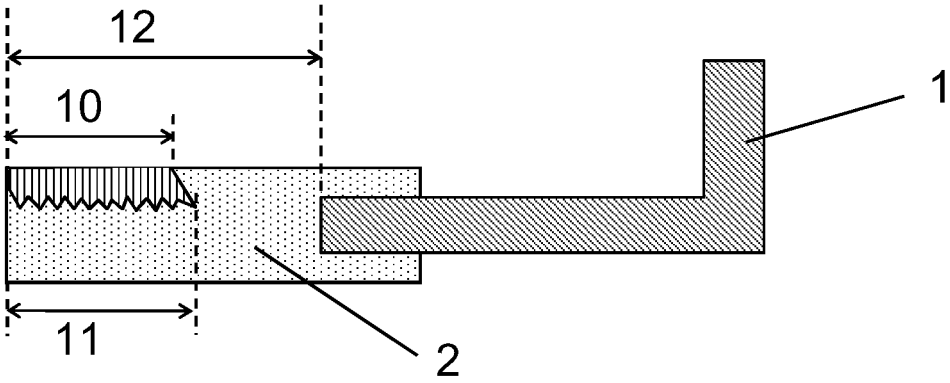
FIG. 3B is a schematic sectional view showing another example of the embodiments of the present invention.
Figure 5A:
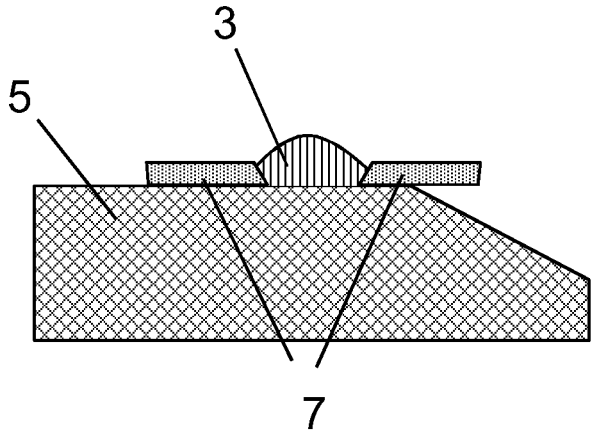
FIG. 5A is a schematic sectional view to illustrate how to form the touching part in the manufacturing process of the present invention.
Figure 5B:
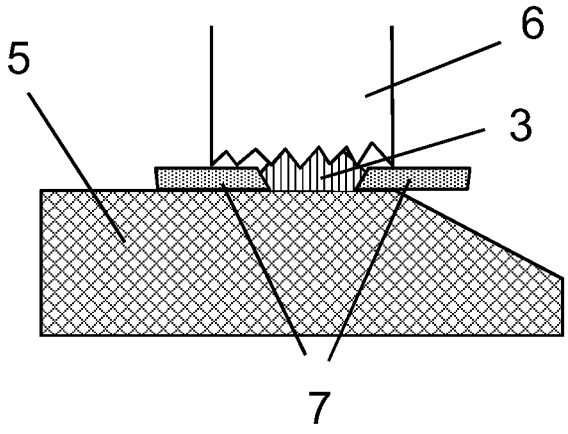
FIG. 5B is a schematic sectional view to illustrate how to form the touching part in the manufacturing process of the present invention.

About the width of the touching part at its cross section in the lateral direction of the touching part, an internal width 11 of the touching part may be formed in a larger width than an external width 10 of the touching part (see FIGS. 3A and 3B), and this enables the touching part and the blade member to be bonded at a stronger bonding force. Accordingly, it is preferable that, in a cross section that extends in the lateral direction of the touching part and on a plane perpendicular to its touching face, the internal width of the touching part is larger than the width of the touching face of the touching part. Also, it is much preferable that, in the cross section that extends in the lateral direction of the touching part and on a plane perpendicular to its touching face, the width of the touching part stands continuously (or gradually) larger from the touching face toward the joint surface (bonding surface) of the touching part. For example, such set-up may be taken by using, as shown in FIGS. 5A and 5B, a guide member 7 which controls the shape of the touching part material. A touching part with such set-up may be formed in, e.g., such a way that, when a touching part material is placed on a top force 5 of a mold or after it has been placed thereon, the top force 5 is provided thereon with the guide member 7 in the manner as shown in FIGS. 5A and 5B and then the touching part material is cured. That is, the touching part is formed along the side walls of an opening of the guide member, and hence the angle of slope of the opening side walls of the guide member may be controlled, whereby a blade for electrophotographic apparatus can be obtained which has been so set up that the width of the touching part stands gradually larger from the touching face toward the joint surface.

As described above, as the material for the touching part, a material is used which is different from the material for the blade member. Usable are, e.g., polyester resins, polyurethane resins, urea resins, polycarbonate resins, melamine resins, phenol resins, polyamide resins, silicone resins, acrylic resins and fluorine resins, any of which may be used alone or in the form of a mixture of two or more types. Taking account of the bond performance between the touching part and the blade member, it is preferable to use a material having the same functional group as that for the blade member.

The touching face of the touching part also has a coefficient of static friction which is smaller than the coefficient of static friction of the surface of the blade member. From the viewpoint of blade turn-over, the touching face of the touching part may preferably have a coefficient of static friction of 1.6 or less, and much preferably 1.5 or less.

As the shape of the touching part in its cross section in the lateral direction, it may be any shape as long as any rubber properties of the blade member are not impaired. In this connection, it is preferable for the blade to satisfy the following expression 1.

$$0.1 \leq (S1/S2) \times (H1/H2) \leq 0.4 \qquad \text{Expression 1}$$

where, in the blade member cross section that extends in the lateral direction of the touching part and on a plane perpendicular to its touching face, the sectional area of the touching part is represented by S1, the sum of the sectional area of the touching part and the sectional area of the blade member excluding that of the part joining with the support member is represented by S2, the microhardness of the touching part is represented by H1 and the microhardness of the blade member is represented by H2.

Setting the sectional-area ratio S1/S2 small in the lateral direction cross section enables the touching part material to be kept from impair any rubber properties of the blade member, and facilitates uniform touch with the photosensitive member and so forth, so that any faulty cleaning can be prevented from coming. Also, the larger microhardness ratio H1/H2 of the microhardness H1 of the touching part to the microhardness H2 of the blade member is, the more preferable it is to set the sectional-area ratio S1/S2 small. Hence, the range defined by the expression 1 is preferable, which specifies the relationship between the sectional-area ratio S1/S2 and the microhardness ratio H1/H2.

Where the shape of the touching part is substantially rectangular, the sectional areas S1 and S2 may be calculated by width×thickness. Also, where the shape thereof is irregular, the sectional areas S1 and S2 may be found by using a digital microscope (VHX-900, manufactured by Keyence Corporation) and using a program which calculates various areas.

Figure 2B:
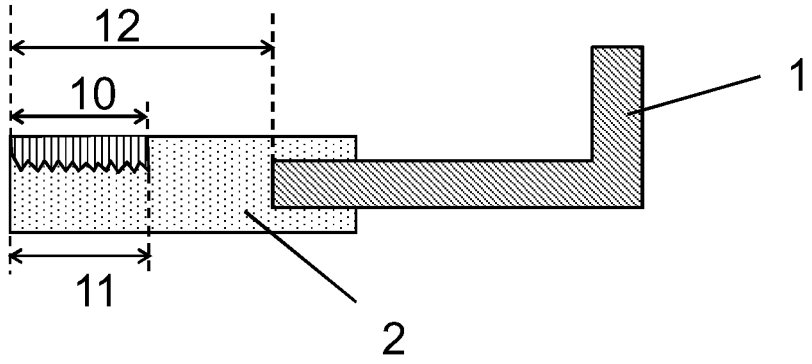
FIG. 2B is a schematic sectional view showing an example of the embodiments of the present invention.

The sectional area excluding that of the part joining with the support member in the blade member is the sectional area defined by the surface width shown by an arrow 12 in FIG. 2B. Therefore, where the cross section of the blade member is rectangular, the S2 is calculated as the sum of the sectional area S1 and the sectional area found from the thickness of the blade member and the surface width 12, excluding the sectional area of the part where the blade member joins with the support member.

The microhardness is measured with a dynamic ultra-microhardness meter (DUH-W201S, manufactured by Shimadzu Corporation) to make measurement under conditions of 23° C. and using a 115° triangular pyramid indenter, and then calculated according to the following expression 2 from the measured values.

$$H = \alpha \times (P/D^2) \qquad \text{Expression 2}$$

wherein H represents the microhardness; α, the constant determined by the shape of the indenter; P, the force of loading; and D, the measured value (depth of indentation: μm) found where the indenter has entered into a sample.

In the present invention, in the above measurement, the constant α of the indenter is 3.8584, and the measurement is made under P: 1.0 mN, loading rate: 0.028439 mN/s, and retention time: 5 seconds.

As the material used for the blade member, there are no particular limitations thereon as long as it is an elastic material, and a heat-curable polyurethane elastomer is preferred as having superior wear resistance and resistance to compression set. The heat-curable polyurethane elastomer is chiefly composed of a polyisocyanate compound, a high-molecular weight polyol, a chain extender that is a bifunctional or trifunctional low-molecular weight polyol, and a catalyst.

The polyisocyanate may include, e.g., 4,4'-diphenylmethane diisocyanate (MDI), 2,4-tolylene diisocyanate (2,4-TDI), 2,6-tolylene diisocyanate (2,6-TDI), xylene diisocyanate (XDI), 1,5-naphthylene diisocyanate (1,5-NDI), p-phenylene diisocyanate (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), carbodiimide-modified MDI, and polymethylene phenyl polyisocyanate (PAPI). In particular, it is preferable to use MDI.

The high-molecular weight polyol may include, e.g., polyester polyols, polyether polyols, caprolactone ester polyols, polycarbonate ester polyols, and silicone polyols. Also, it is preferable for any of these to have a number-average molecular weight of from 1,500 to 4,000. As long as the polyol has a number-average molecular weight of 1,500 or more, the urethane rubber obtained can have good physical properties, and, as long as it has a number-average molecular weight of 4,000 or less, the prepolymer obtained can have an appropriate viscosity, promising easy handling.

The chain extender may include, e.g., glycols. The glycols may include, e.g., ethylene glycol (EG), diethylene glycol (DEG), propylene glycol (PG), dipropylene glycol (DPG), 1,4-butanediol (1,4-BD), 1,6-hexanediol (1,6-HD), 1,4-cyclohexanediol, 1,4-cyclohexanedimethanol, xylylene glycol (terephthalyl alcohol), and triethylene glycol. Besides the above glycols, other polyhydric alcohols may also be used. Such polyhydric alcohols may include, e.g., trimethylolpropane, glycerin, pentaerythritol and sorbitol. Any of these may be used alone or in combination of two or more types.

As the catalyst, a polyurethane curing catalyst may be used which is commonly used, and may include, e.g., tertiary amine catalysts. Such tertiary amine catalysts may be exemplified by amino-alcohols such as dimethylethanolamine, trialkylamines such as triethylamine, tetraalkyldiamines such as N,N,N',N'-tetramethyl-1,3-butanediamine, triethylenediamine, piperazine types, and triazine types. A metallic catalyst usually used for urethane may also be used, as exemplified by dibutyltin dilaurate.

The catalyst may also contain an isocyanurating catalyst which accelerates isocyanuration. By virtue of its temperature-sensitivity, the isocyanurating catalyst can control curing reaction in a mixing chamber set lower than curing temperature, and, after materials have been casted into a mold and have reached the curing temperature, it can make the curing reaction proceeds at one burst. Hence, it can keep the reaction from proceeding non-uniformly in the mixing chamber, so that the blade to be obtained by molding can be kept from being non-uniform in hardness.

The isocyanurating catalyst may include, e.g., the following: tertiary amines such as N-ethylpiperidine, N,N'-dimethylpiperazine and N-ethylmorphorine; hydroxides or organic weak acid salts of tetraalkylammonium such as tetramethylammonium, tetraethylammonium and tetrabutylammonium; hydroxides or organic weak acid salts of hydroxyalkylammonium such as trimethylhydroxypropylammonium and triethylhydroxypropylammonium; and alkali metal salts of carboxylic acids such as acetic acid, propionic acid, butyric acid, caproic acid, capric acid, valeric acid, octylic acid, myristic acid and naphthenic acid. Any of these may be used alone or in combination of two or more types. In particular, metal salts of carboxylic acids are preferred, which may less cause any blooming after molding to contaminate any other member(s).

The above materials may optionally be blended with any other catalyst, a pigment, a plasticizer, a waterproofing agent, an antioxidant, an ultraviolet absorber, a light stabilizer and so forth.

The blade member may be produced using the above materials and usually according to, e.g., a prepolymer method and a semi-one-shot method.

The blade for electrophotographic apparatus according to the present invention may be used as a cleaning blade, a developing blade or the like of any electrophotographic apparatus such as copying machines, laser beam printers, light-emitting diode printers (LED printers) and apparatus where electrophotography is applied, such as electrophotographic platemaking systems. Also, the blade for electrophotographic apparatus according to the present invention may preferably be so set up that a blade member formed of the polyurethane elastomer produced using the above polyurethane raw-material composition and the support member are joined together. The support member and the blade member may have any shapes, and may have shapes suited for the use purpose, without any particular limitations.

The blade for electrophotographic apparatus according to this embodiment may be manufactured by, e.g., the following method. First, a mold for, e.g., cleaning blade is readied which is constituted of an upper force and a bottom force. Next, the touching part material is placed on a part of a mirror surface portion of the top force, which forms the touching face, in the form of a straight in the longitudinal direction. Subsequently, the plate member having the roughened face having a stated roughened-surface profile is pressed at the roughened face against the touching part material to transfer the roughened-surface profile to the touching part material, which is then cured, and thereafter the plate member is removed. Subsequently, one end portion of the support member is placed in a cavity of the mold, and thereafter, as a material for the blade member, the above polyurethane raw-material composition is casted into the cavity of the mold, followed by heating to effect curing, whereby a cleaning blade can be obtained a plate-like blade member and the support member of which stand integrally formed. Another method may also be employed in which a sheet-like blade member is produced without placing the support member in the mold in the above method, and a joining part of the sheet-like blade member is superposed on a support member having been coated or stuck with an adhesive, and then both the blade member and the support member are bonded by heating under pressure.

As to a material making up the support member, the support member may also be made of any material without any particular limitations, including metals and resins, stated more specifically, metallic materials such as steel sheets, stainless steel sheets, zinc-coated chromate film steel sheets and chromium-free steel sheets, and resin materials such as 6-nylon and 6,6-nylon. The support member and the blade member may be joined together by any method without any particular limitations, and a suitable method may be selected from among known methods. Stated specifically, it may include, e.g., a method in which these are bonded together by using an adhesive such as a phenolic resin.

EXAMPLES

The present invention is described below in greater detail by giving Examples. The present invention is by no means limited to these Examples.

Example 1

(1) Formation of Touching Part

A mold for cleaning blade was readied which was constituted of an upper force and a bottom force, and a touching part material 1 shown below was placed on a part of a mirror surface portion of the top force, which formed the touching face, at a preset position in the lateral direction and in the form of a straight of 2 mm in width and 1 mm (corresponding to thickness) in height in the longitudinal direction. Here, the preset position is the position where both the external width (i.e., touching width) and the internal width of the touching part come to 1.7 mm as a result of the cutting in a later step. More specifically, where the cut length from a standard in the lateral direction of the support member is represented by A (mm), it is the position where the position of formation of the touching part in the lateral direction is at 2 mm in width within the range of from (A−1.7) (mm) to (A+0.3) (mm) and both the touching width and the internal width of the touching part come to 1.7 mm as a result of the cutting and the touching width and internal width having been removed by the cutting come to 0.3 mm. Thereafter, a plate member made of a fluorine resin, having a roughened face with a center line average roughness Ra of 0.6 μm, was pressed at the roughened face against the touching part material in such a way that the space between the roughened face and the mold was 0.8 mm, where this touching part material was subjected to curing reaction at 130° C. for 2 minutes, and then the plate member was removed.

(Touching Part Material 1)

296.6 g of 4,4'-diphenylmethane diisocyanate and 703.4 g of butylene adipate polyester polyol of 2,000 in number-average molecular weight were allowed to react at 80° C. for 3 hours to obtain a prepolymer having an NCO(%) of 7.0%. This was mixed with a curing agent obtained by adding 0.27 g of KAOLIZER No. 25 (available from Kao Corporation) to a mixture of 53.9 g of 1,4-butanediol and 13.5 g of trimethylolpropane to prepare a touching part material 1.

(2) Formation of Blade Member

A support member was readied which was coated with a phenolic adhesive at its one end portion on the one end side. A mold for cleaning blade (the total thickness of the touching part and the blade member was 2.0 mm) was readied on the upper force of which the touching part was beforehand formed in the above (1), and the support member was placed therein in the state that its one end portion on the one end side projected into a cavity for forming blade member, of the mold. Here, the mold and the support member were placed in such a positional relationship between them that the surface width of the blade member excluding its part joining with the support member came to 3 mm as a result of the cutting in a later step. Thereafter, a blade member material shown below was casted into the mold and subjected to curing reaction at 130° C. for 1 minute, and thereafter the cured product obtained was demolded.

(Blade Member Material)

334.7 g of 4,4'-diphenylmethane diisocyanate and 665.3 g of butylene adipate polyester polyol of 2,500 in number-average molecular weight were allowed to react at 80° C. for 3 hours to obtain a prepolymer having an NCO(%) of 9.0%. This was mixed with a curing agent obtained by adding 0.08 g of DABCO P15 (an ethylene glycol solution of potassium acetate, available from Air Products Japan, Inc.) and 0.34 g of KAOLIZER No. 25 (available from Kao Corporation) to a mixture of 154.0 g of hexylene adipate polyester polyol of 1,000 in number-average molecular weight and 26.7 g of 1,4-butanediol and 21.9 g of trimethylolpropane to prepare a blade member material.

(3) Manufacture of Cleaning Blade

The cured product obtained was cut in its longitudinal direction in order to make an edge of the touching part, to manufacture a cleaning blade the blade member of which excluding its part joining with the support member was 3 mm in surface width.

Example 2

A cleaning blade was manufactured in the same way as that in Example 1 except that, when the touching part was formed, a plate member made of a fluorine resin, having a roughened face with a center line average roughness Ra of 5.5 μm, was used.

Example 3

A cleaning blade was manufactured in the same way as that in Example 1 except that, when the touching part was formed, a plate member made of a fluorine resin, having a roughened face with a center line average roughness Ra of 12 μm, was used.

Example 4

A cleaning blade was manufactured in the same way as that in Example 2 except that, when the touching part was formed, such a guide member made of a fluorine resin that the touching face width (external width) was to come to 1.7 mm and the joint surface width (internal width) to 2.0 mm in the lateral direction of the touching part was set and thereafter the touching part material 1 was casted into the mold.

Example 5

A cleaning blade was manufactured in the same way as that in Example 2 except that a touching part material 2 shown below was used as the touching part material and was applied to a part of the mirror surface portion of the top force by coating, which formed the touching face, in the form of a straight of 2 mm in width and 0.1 mm in height in the longitudinal direction.

(Touching Part Material 2)

100 g of a chief agent acrylic urethane resin UTHANAL (available from Ohashi Chemical Industries Ltd.) and the same curing agent as that of the touching part material 1 was mixed to prepare a touching part material 2.

Example 6

A cleaning blade was manufactured in the same way as that in Example 2 except that a touching part material 3 shown below was used as the touching part material and was so placed that, as its position in the lateral direction, both the external width and the internal width of the touching part came to 1.0 mm as a result of the cutting in the later step, and that the time for the curing at 130° C. was changed to 30 minutes.

(Touching Part Material 3)

Hydroxyl groups at the both terminals of a modified silicone oil (X-22-160AS, available from Shin-Etsu Chemical Co., Ltd.; hydroxyl value: 112) were allowed to react with adipic acid by conventional procedure and further likewise allowed to react with ethylene glycol to synthesize a polyester polyol having hydroxyl groups at the both terminals and of 87.6 in hydroxyl value. Next, 340.0 g of 4,4'-diphenylmethane diisocyanate and 660.0 g of the polyester polyol were allowed to react at 80° C. for 3 hours to obtain a prepolymer having an NCO(%) of 6.2%. This was mixed with a curing agent obtained by adding 0.27 g of KAOLIZER No. 25 (available from Kao Corporation) to a mixture of 39.0 g of 1,4-butanediol and 21.0 g of trimethylolpropane to prepare a touching part material 3.

Example 7

A cleaning blade was manufactured in the same way as that in Example 2 except that the touching part material was so placed that, as its position in the lateral direction, both the external width and the internal width of the touching part came to 0.5 mm as a result of the cutting in the later step, and that, when the touching part was formed, the plate member made of a fluorine resin was pressed at its roughened face against the touching part material in such a way that the space between the roughened face and the mold was 0.6 mm.

Example 8

A cleaning blade was manufactured in the same way as that in Example 6 except that the touching part material was so placed that, as its position in the lateral direction, both the external width and the internal width of the touching part came to 1.0 mm as a result of the cutting in the later step, and that, when the touching part was formed, the plate member made of a fluorine resin was pressed at its roughened face against the touching part material in such a way that the space between the roughened face and the mold was 0.6 mm.

Comparative Example 1

A cleaning blade was manufactured in the same way as that in Example 1 except that, when the touching part was formed, the curing reaction was carried out without pressing against the touching part material any plate member made of a fluorine resin.

Comparative Example 2

A cleaning blade was manufactured in the same way as that in Example 1 except that, when the touching part was formed, a plate member made of a fluorine resin, having a roughened face with a center line average roughness Ra of 22 μm, was used.

Comparative Example 3

A cleaning blade was manufactured in the same way as that in Example 1 except that a touching part material 4 shown below was used as the touching part material.

(Touching Part Material 4)

296.6 g of 4,4'-diphenylmethane diisocyanate and 703.4 g of ethylene adipate polyester polyol of 2,000 in number-average molecular weight were allowed to react at 80° C. for 3 hours to obtain a prepolymer having an NCO(%) of 7.0%. This was mixed with a curing agent obtained by adding 0.27 g of KAOLIZER No. 25 (available from Kao Corporation) to a mixture of 43.8 g of 1,4-butanediol and 23.6 g of trimethylolpropane to prepare a touching part material 4.

Measurement of Joint Surface Roughness

About the touching part formed using the touching part material, corresponding test product for measuring the center line average roughness Ra of joint surface was prepared other than the above manufacture of cleaning blades, and was used to measure the center line average roughness Ra. It was measured with a surface roughness meter (SURFCORDER SE3500, manufactured by Kosaka Laboratory Ltd.) at a measuring rate of 0.1 mm/second, in a measuring length of 2.5 mm and at a cut-off value of 0.8 mm, according to JIS B-0601 (1994). Incidentally, the center line average roughness Ra may also be found in the following way. First, the cleaning blade manufactured was cut in the lateral direction of the touching part and on a plane perpendicular to its touching face. Next, using a digital microscope (VHX-900, manufactured by Keyence Corporation) and a zoom lens (VH-Z20R, manufactured by Keyence Corporation), the joint surface was observed at an objective magnification of 1,000 times to extract a roughness profile.

Measurement of Coefficient of Static Friction

The coefficient of static friction at the respective surfaces of the touching part and blade member of cleaning blade manufactured was measured with HEIDON Surface Properties Tester (Type 14FW, manufactured by Shinto Kagaku K.K.). For its measurement, a ball indenter made of stainless steel which was of 10 mm in diameter and to which a load of 0.1 kg was kept applied was brought into touch with the surface, and the ball indenter was moved at a rate of 50 mm/minute to make measurement.

Measurement of Microhardness

The microhardness of the respective surfaces of the touching part and blade member of cleaning blade manufactured was measured with a dynamic ultra-microhardness meter (DUH-W201S, manufactured by Shimadzu Corporation) to make measurement under conditions of 23° C. and using a 115° triangular pyramid indenter. The microhardness H was calculated from the measured values found and according to the following expression 2.

$$H=\alpha\times(P/D^2) \qquad \text{Expression 2}$$

Wherein α represents the constant determined by the shape of the indenter; P, the force of loading; and D, the measured value (depth of indentation: μm) found where the indenter has entered into a sample.

In the present invention, in the above measurement, the constant α of the indenter was 3.8584, and the measurement was made under P: 1.0 mN, loading rate: 0.028439 mN/s, and retention time: 5 seconds.

Measurement of Sectional Shape

The cleaning blade manufactured was cut in the lateral direction of the touching part and on a plane perpendicular to its touching face, and the sectional shape of the touching part was observed by using a digital microscope and a zoom lens and at an objective magnification of 100 times to measure the thickness, external width and internal width of the touching part. Then, the sectional area S1 of the cross section of the touching part was calculated. Here, as the digital microscope, VHX-900 (trade name; manufactured by Keyence Corporation) was used, and as the zoom lens, VH-Z20R (trade name; manufactured by Keyence Corporation).

Actual-service Evaluation

The cleaning blade manufactured was incorporated in Image RUNNER 6000 (manufactured by CANON INC.), and initial-stage solid white image (without printing) was reproduced in a low-temperature and low-humidity environment (15° C./10% RH) to make evaluation on any occurrence of vertical lines due to faulty cleaning. Thereafter, a 500,000-sheet printing test was conducted to examine whether or not the touching part came separated from the blade member to make evaluation as bond performance. Also, about evaluation on blade turn-over at the initial stage, the cleaning blade was incorporated in the printer under such setting that the level of penetration in the photosensitive member was normal, +0.2 mm and +0.4 mm, to make evaluation on whether or not the blade came to turn over.

Results obtained are shown in Table 1. Here, the sectional area S2 in the item of "Blade member cross section" in Table 1 represents the sum of the sectional area S1 of the touching part and the sectional area of the blade member.

TABLE 1

| | | Joint surface | Coefficient of static friction | | Microhardness | | | Touching part cross section | | | |
|---|---|---|---|---|---|---|---|---|---|---|---|
| | | | | | Blade | Touching | Micro- hardness | Width | | ** | Sec · area |
| | * Tpm | Ra (μm) | Blade member | Touching part | member H2 | part H1 | ratio H1/H2 | External (mm) | Internal (mm) | Tkn (mm) | S1 ($mm^2$) |
| Example: | | | | | | | | | | | |
| 1 | 1 | 0.5 | 3.5 | 1.6 | 0.08 | 0.16 | 2 | 1.7 | 1.7 | 0.8 | 1.36 |
| 2 | 1 | 5 | 3.5 | 1.6 | 0.08 | 0.16 | 2 | 1.7 | 1.7 | 0.8 | 1.36 |
| 3 | 1 | 10 | 3.5 | 1.6 | 0.08 | 0.16 | 2 | 1.7 | 1.7 | 0.8 | 1.36 |
| 4 | 1 | 5 | 3.5 | 1.6 | 0.08 | 0.16 | 2 | 1.7 | 2.0 | 0.8 | 1.48 |
| 5 | 2 | 5 | 3.5 | 1.5 | 0.08 | 0.8 | 10 | 1.7 | 1.7 | 0.1 | 0.17 |
| 6 | 3 | 5 | 3.5 | 1.0 | 0.08 | 0.32 | 4 | 1.0 | 1.0 | 0.8 | 0.80 |

TABLE 1-continued

| | | | | | | | | | | | |
|---|---|---|---|---|---|---|---|---|---|---|---|
| 7 | 1 | 5 | 3.5 | 1.6 | 0.08 | 0.16 | 2 | 0.5 | 0.5 | 0.6 | 1.30 |
| 8 | 3 | 5 | 3.5 | 1.0 | 0.08 | 0.32 | 4 | 1.0 | 1.0 | 0.6 | 0.60 |
| Comparative Example: | | | | | | | | | | | |
| 1 | 1 | 0.2 | 3.5 | 1.6 | 0.08 | 0.16 | 2 | 1.7 | 1.7 | 0.8 | 1.36 |
| 2 | 1 | 20 | 3.5 | 1.6 | 0.08 | 0.16 | 2 | 1.7 | 1.7 | 0.8 | 1.36 |
| 3 | 4 | 0.5 | 3.5 | 4.0 | 0.08 | 0.07 | 0.875 | 1.7 | 1.7 | 0.8 | 1.36 |

| | Blade member cross section | | | | | Evaluation | | |
|---|---|---|---|---|---|---|---|---|
| | Surface width (mm) | ** Tkn (mm) | Sec · area S2 ($mm^2$) | Sec · area ratio S1/S2 | (S1/S2) × (H1/H2) | Bond performance *1 | Blade turnover *2 | Faulty cleaning *3 |
| Example: | | | | | | | | |
| 1 | 3 | 2 | 6 | 0.23 | 0.45 | A | A | A |
| 2 | 3 | 2 | 6 | 0.23 | 0.45 | A | A | A |
| 3 | 3 | 2 | 6 | 0.23 | 0.45 | A | A | A |
| 4 | 3 | 2 | 6 | 0.25 | 0.49 | AA | A | A |
| 5 | 3 | 2 | 6 | 0.03 | 0.28 | A | A+ | AA |
| 6 | 3 | 2 | 6 | 0.13 | 0.53 | A | A++ | A |
| 7 | 3 | 2 | 6 | 0.05 | 0.10 | A | A | AA |
| 8 | 3 | 2 | 6 | 0.10 | 0.40 | A | A++ | AA |
| Comparative Example: | | | | | | | | |
| 1 | 3 | 2 | 6 | 0.23 | 0.45 | C | A | A |
| 2 | 3 | 2 | 6 | 0.23 | 0.45 | A | A | C |
| 3 | 3 | 2 | 6 | 0.23 | 0.20 | — | C | A |

* Touching part material;
** Thickness
In Table 1;
*1 AA: The touching part does not come separated.
A: The touching part slightly comes separated as a result of running, but no problem in practical use.
C: The touching part comes separated as a result of running.
—: Not evaluated.
*2 A++: The blade does not come to turn over at the level of penetration of +0.4 mm.
A+: The blade does not come to turn over at the level of penetration of +0.2 mm.
A: The blade does not come to turn over at the level of penetration of normal setting.
C: The blade comes to turn over at the level of penetration of normal setting.
*3 AA: Any faulty cleaning does not come.
A: Faulty cleaning comes slightly, but no problem in practical use.
C: Faulty cleaning comes.

In Examples 1 to 8, there was no problem in practical use about coming separated as a result of running, blade turn-over and faulty cleaning. In particular, in Examples 5, 6 and 8, the blade did not come to turn over at all even though the level of blade penetration was set large. Also, in Examples 5, 7 and 8, any faulty cleaning did not come at all. On the other hand, in Comparative Example 1, the touching part came separated because it was small in roughness at its joint surface. Also, in Comparative Example 2, the touching part was non-uniform in touch pressure because of a large roughness at its joint surface, to cause faulty cleaning. Still also, in Comparative Example 3, the blade turn-over came because of a large coefficient of static friction of the touching face.

The blade for electrophotographic apparatus according to the present invention is usable as the cleaning blade, the developing blade or the like of any electrophotographic apparatus such as copying machines, laser beam printers, light-emitting diode printers (LED printers) and apparatus where electrophotography is applied, such as electrophotographic platemaking systems.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-077776, filed Mar. 30, 2010, and Japanese Patent Application No. 2010-260124, filed Nov. 22, 2010, which are hereby incorporated by reference herein in their entirety.

What is claimed is

1. blade for electrophotographic apparatus which blade comprises a blade member having a touching part which is to come into touch with an object member, and at a support member which holds the blade member;

the touching part comprising a material which is different from a material used for the blade member;

the touching part is formed in such a way that a touching face thereof stands bare on the same plane as the blade member and the touching part is embedded in the blade member;

the touching part having a touching face having a coefficient of static friction which is smaller than a coefficient of static friction of a surface of the blade member; and the touching part having a joint surface at which the touching part is joined with the blade member which joint surface has a center line average roughness Ra of from 0.5 μm to 10.0 μm.

2. The blade for electrophotographic apparatus according to claim 1, wherein, in a cross section that extends in a lateral direction of the touching part and on a plane perpendicular to the touching face, an internal width of the touching part is larger than a width of the touching face of the touching part.

3. The blade for electrophotographic apparatus according to claim 2, wherein, in the cross section that extend in the lateral direction of the touching part and on the plane perpendicular to the touching face, the width of the toughing part stands gradually larger from the touching face toward the Joint surface of the touching part.

4. the blade for electrophotographic aparatus according to claim 1, wherein the touching face of the touching part has a coefficient of static friction of 1.5 or less.

5. The blade for electrophotographic apparatus according to claim 1, which satisfies the following expression:

$$0.1 \leq (S1/S2) \times (H1/H2) \times 0.4$$

where, in the blade member cross section that extends in the lateral direction of the touching part and On the plane perpendicular to the touching face thereof, a sectional area of the touching part is represented by S1, a sum of the sectional area of the touching part and a sectional area of the blade member excluding that of the part joining with the support member is represented by S2, a microhardness of the touching part is represented by H1 and a microhardness of the blade member is represented by H2.

6. A process for manufacturing a blade for electrophotographic apparatus which blade comprises a blade member having a touching part which is to Come into touch with an object member, and a support member which holds the blade member; the process comprising the steps of:

(1) placing a Material for the touching part of an internal surface of a mold with which the blade member is to be molded;

(2) curing the material for the touching part while a surface thereof is so formed as to have a center line average roughness Ra of 0.5 μm to 10.0 μm; and (3) casting a material for the blade member into the mold, followed by heat curing.

7. The process for manufacturing a blade for electrophotographic apparatus according to claim 6, wherein the to (2) is a step of curing the material in a state that a plate member having a roughened face with a center line average roughness Ra of 0.5 μm to 10.0 μm is pressed against the material for the touching part.

* * * * *